United States Patent [19]

Boynton

[11] Patent Number: 4,956,878

[45] Date of Patent: Sep. 18, 1990

[54] SWIM SUIT CONSTRUCTION

[76] Inventor: Nancy V. Boynton, 5814 Vestavia Dr., Houston, Tex. 77069

[21] Appl. No.: 394,476

[22] Filed: Aug. 16, 1989

Related U.S. Application Data

[62] Division of Ser. No. 117,488, Nov. 5, 1987.

[51] Int. Cl.[5] ..... A41D 7/00

[52] U.S. Cl. ..... 2/67; 450/11; 450/30; 2/243 R

[58] Field of Search ..... 2/67; 450/11, 15, 30, 450/31, 33

[56] References Cited

U.S. PATENT DOCUMENTS

| | | | |
|---|---|---|---|
| 1,361,155 | 12/1920 | Jackson | 450/30 X |
| 1,834,846 | 1/1931 | Karnopp | 450/31 |
| 1,985,568 | 12/1934 | Hall | 2/67 X |
| 1,989,753 | 2/1935 | Ide | 2/67 |
| 1,990,322 | 2/1935 | Goldberg | 450/31 |
| 1,994,990 | 3/1935 | Flesh | 450/33 |
| 2,033,456 | 3/1936 | Cunningham | 2/67 |
| 2,550,327 | 4/1951 | Christensen | 2/67 |
| 2,896,216 | 7/1959 | Spewak | 2/67 X |
| 3,098,485 | 7/1963 | Howell | 450/31 |
| 3,161,200 | 12/1964 | Brickman | 450/31 |
| 3,392,730 | 7/1968 | Relli | 450/30 |
| 3,442,818 | 1/1969 | Erteszek | 450/30 |
| 3,746,007 | 7/1973 | Hand et al. | 450/31 |
| 3,771,172 | 11/1973 | Barg | 2/67 |
| 4,071,236 | 1/1978 | Oprean | 2/67 X |
| 4,372,320 | 2/1983 | Silber | 450/31 |
| 4,378,805 | 4/1983 | Reichert et al. | 450/31 X |
| 4,398,538 | 8/1983 | Johnson | 2/67 X |
| 4,412,542 | 11/1983 | Reichert | 450/11 X |
| 4,440,174 | 4/1984 | Cordova | 450/31 |
| 4,507,801 | 4/1985 | Kavanagh et al. | 2/2 |
| 4,564,015 | 1/1986 | Friedman | 450/31 |
| 4,571,742 | 2/1986 | Wior | 2/67 |
| 4,583,544 | 4/1986 | Flannagan et al. | 2/67 |
| 4,853,976 | 8/1989 | Mertz | 2/67 |

*Primary Examiner*—Werner H. Schroeder
*Assistant Examiner*—Jeanette E. Chapman
*Attorney, Agent, or Firm*—Pearne, Gordon, McCoy & Granger

[57] ABSTRACT

A garment for securely supporting a person while allowing freedom of movement that includes a front outer shell of at least two-way stretchable fabric, a first liner stretchable in at least two directions and having the same general shape as the front outer shell when attached along its periphery. A support member of two-way vertically stretchable fabric to permit stretching for vertical movement while providing lateral support is attached at least along its upper edge and one other edge. A rear outer shell is shaped and has complementary edges for attaching it to the front outer shell and liner. Elastic is placed in some of the seams to provide support for the garment.

5 Claims, 3 Drawing Sheets

SWIM SUIT CONSTRUCTION

This is a division, of application Ser. No. 07/117,488, filed Nov. 5, 1987.

BACKGROUND OF THE INVENTION

This invention relates to athletic garments which have the apparent contradictory necessities of providing very firm support while permitting unrestricted movement. In athletic endeavors, such as diving, the protection of the genitals and the breast is of paramount importance to a diver, and the enhancement of the competitive athlete's appearance can have a positive effect on the judging. Also, the garments have the function of providing support to the body in general during extreme stretching, bending, and twisting motions. It is also necessary, of course, that the suit stay flush with the diver's body and in position. Needless to say, it would be highly undesirable if the suit should shift relative to the body of the user either during the diving motion, the entry into the water, or during swimming action.

It is also important in the design of athletic garments to permit unrestricted motion. If the garment tended to pull or bend, there could be several undesirable results, e.g., the timing of the athlete could be thrown off or a diver could be thrown off balance.

In the past, there have been many attempts to solve this problem by the use of simple elastic materials. Samples of the garments with built-in supports are illustrated in Friedman U.S. Pat. No. 4,564,015 and Johnson U.S. Pat. No. 4,398,538, the contents of which are hereby included by reference. The Friedman patent discloses a lady's garment with a bra component along the inside of the top. The integral bra is attached along the top seam but is not attached along the bottom edge or the side seams. As a result, the bra may tend to move separately from the suit for a limited motion, and separate motion of the garments may be possible. A similar type of construction is shown in the Johnson patent.

The present invention has provided for the firm support of the user of an athletic garment by providing a combination of shells and liners of two-and four-way stretch materials. In particular, a liner and/or a support is normally used which only stretches in one direction, e.g., horizontally, and is referred to hereinafter as a "two-way stretchable fabric or material," in combination with four-way stretch garments, i.e., a fabric that stretches both vertically and horizontally. In particular, the use of a two-way stretch material in a critical portion of the garment allows flexibility in one direction, while providing a firm support in the other direction. The combination of this two-way stretch material as a liner with an outer shell provides a new and unusual result of very substantial support for the user as well as flexibility and adherence of the garment during extreme athletic motions.

This invention also provides for the particular construction of an integral bra with a woman's athletic suit which is attached along the upper and side edges but not the lower edge. This particular attachment allows the bra to provide substantial support while moving with the wearer and the remainder of the suit. It simultaneously, however, allows stretching of the material with the user's motions of stretching, bending, and twisting without becoming disoriented or displaced.

SUMMARY OF THE INVENTION

A support garment for holding and supporting a person securely while allowing ease of movement, including a front outer shell of a stretch fabric, stretchable in at least two directions and having an upper edge, side edges, and a lower edge. A first liner, stretchable in at least two directions and having the same general shape of the front outer shell, is attached to the front outer shell along the upper, side, and bottom edges. A support member of two-way vertically, stretchable fabric having upper, lower, and side edges is attached at least along the upper edge of the outer shell and first liner. A rear outer shell has an upper edge, side edges, and bottom edges which are attached to the corresponding edges of the front outer shell.

DETAILED DESCRIPTION OF THE DRAWINGS

Figure 1:
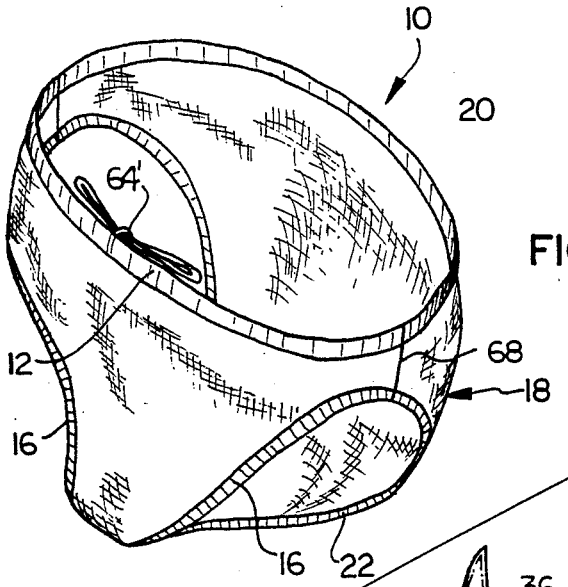
FIG. 1 is a perspective view of a man's athletic garment.
Figure 2:
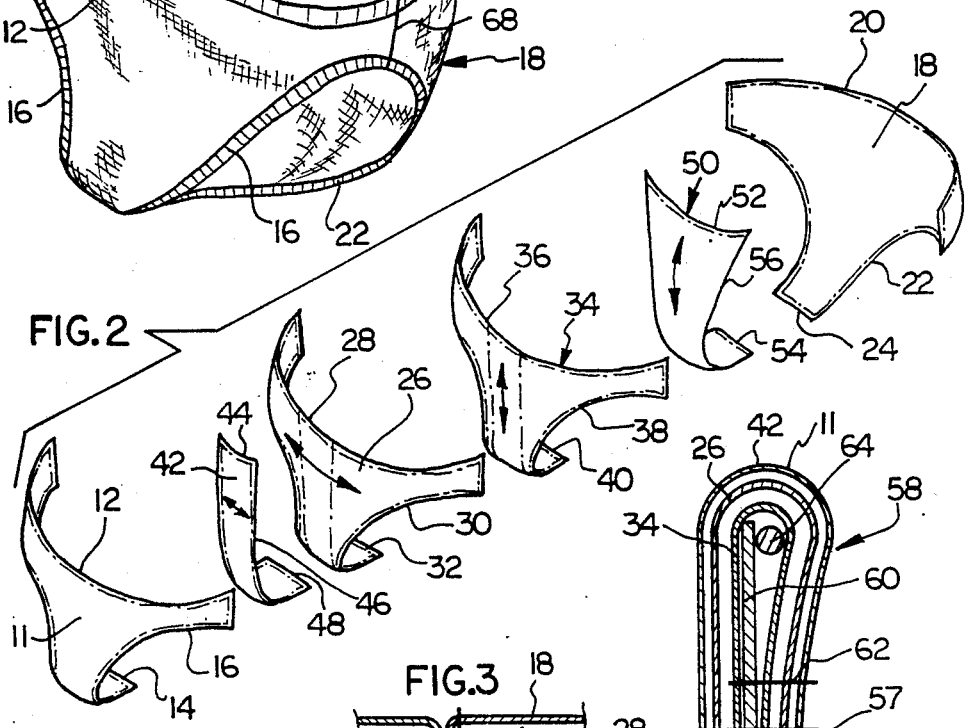
FIG. 2 is a sectionalized, disassembled view of the components of the garment of FIG. 1.

A man's outer garment 10 having an upper edge 12 as illustrated in FIGS. 1 and 2 has a lower edge 14 and side edges generally represented at 16. The side edges are referred to herein to mean all of the edges other than the upper and lower edges. The term "edge" as used in this application also refers to what is generally the outer periphery of a functional component, and need not be the actual extreme outer limit of any one particular component. A rear outer shell 18 has an upper edge 20 and side edges 22. A lower edge 24 is positioned to be complementary with the lower edge 14 of the front outer shell 11. In the men's garment, the front and rear outer shell are customarily, but not necessarily, made of four-way stretch material of commercially available fabrics such as those produced by DuPont Corporation and marketed under the trademark TRICOT, which includes 80% Antron# and 20% Lycra#.

Four-way stretch material as used herein means being stretchable in virtually all directions, but in particular the horizontal and vertical directions as viewed in FIGS. 1 and 2. The use of four-way stretch fabric gives a maximum flexibility to the wearer, and provides a measure of support. It also permits relatively easy egress and ingress to the garment.

A first liner 26 is formed of two-way horizontal stretch material and is shaped so that it has an upper edge 28, side edges 30, and lower edge 32. The shape of the first liner is substantially the same as the front outer shell 11. A second liner 34, made of a two-way stretch fabric stretchable in the vertical direction, is similar in shape to the first liner. It has upper edge 36, side edges 38, and lower edge 40, which are attached to the first liner 26 and the front outer shell 11. This combination of liners, in which one liner is stretchable in the horizontal direction and the other in the vertical direction, provides good support while providing flexibility. It should also be understood that the term "two-way stretch" does not imply that all ability to stretch in the other direction is missing. As used herein, a two-way stretch fabric actually stretches much more significantly in one direction than the other, although there is a minor stretching ability in the other direction.

Therefore, "two-way" stretch fabric as used herein is highly stretchable in one direction but is much more resistant to stretch in a direction perpendicular to such one direction. For example, a two-way stretch fabric stretchable in a horizontal direction is highly resistant to stretch in a vertical direction. Similarly, a two-way stretch fabric stretchable in a vertical direction is highly resistant to stretch in a horizontal direction. On the other hand, four-way stretch fabric is stretchable in both the horizontal and vertical directions.

In order to provide maximum support without additional bulk, a center support 42, generally forming a strip, has an upper edge 44, side edges 46, and a lower edge 48. The center support is attached along its upper edge 44, side edges 46, and lower edge 48 to the first liner 26 and second liner 34. The center support 42 is generally a two-way horizontally stretchable fabric. The attaching is usually effected by stitching with a suitable thread on a machine, but any effective attaching means or method may be used.

A support member 50 may optionally be used with the other structural members to provide additional support in the horizontal direction. The member 50 is a two-way stretch material in the vertical direction, and it has an upper edge 52, a lower edge 54, and side edges 56. By providing support in the horizontal direction and allowing vertical movement, the support stretches with the user as he twists, bends, or stretches, while still providing firm support.

Figure 4:
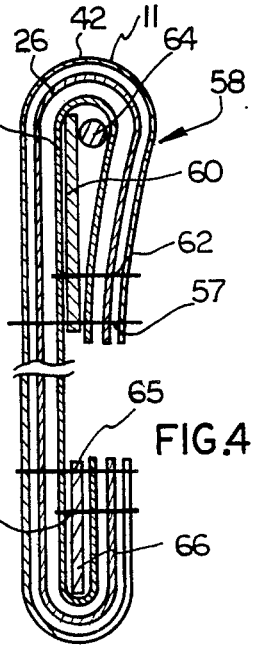
FIG. 4 is a cross-sectional view of the upper and lower seams of the garment of FIG. 1.

The components of the garment 10 are held together at the upper edge by a seam generally illustrated as 58 in FIG. 4, and include an overlap of the outer shell 11, first liner 26, and second liner 34 held by stitching 57. The overlap seam provides a channel in which an elastic band 60 is located and is stitched in place by thread 62. A drawstring 64 generally also passes through the channel and is tied at the front 64 (FIG. 1) to further hold the top edge in place.

A lower seam similarly forms a channel held by stitching 65 in which a second elastic strip 66 is located and held by stitching 62.

Figure 3:
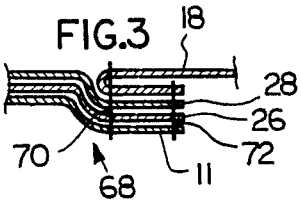
FIG. 3 is a cross-sectional view of a side seam of the garment of FIG. 1.

FIG. 3 is a cross-sectional view of a side seam 68 which shows the front outer shell 11, first liner 26, and second liner 28 stitched to the rear outer shell 18 after it has been lapped and doubled. They are held together by a pair of stitches 70 and 72.

Figure 5:
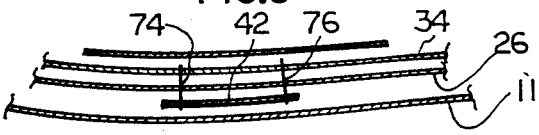
FIG. 5 is a cross-sectional view through the front section of FIG. 1.
Figure 6:
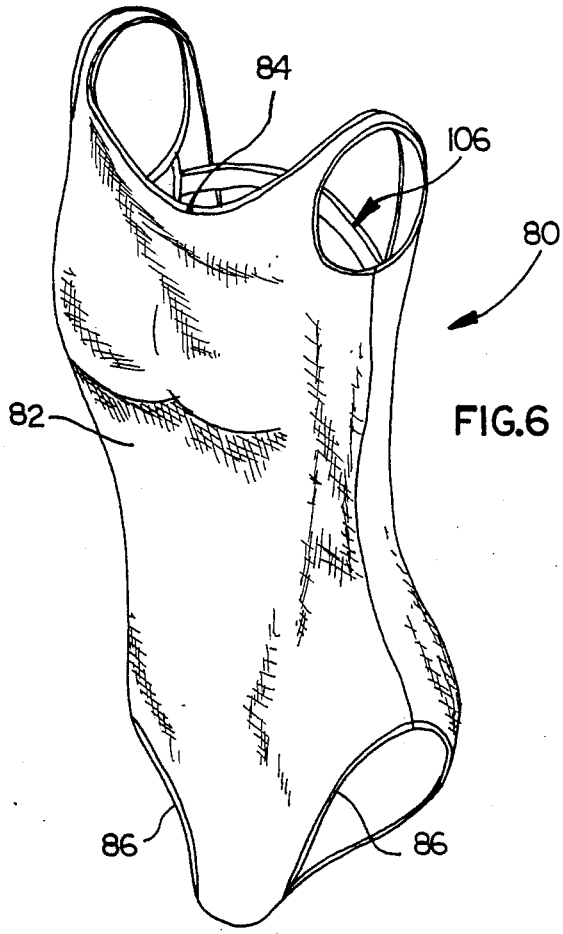
FIG. 6 is a schematic representation of a woman's athletic garment.

FIG. 5 illustrates the construction and stitching of the center support 42 which is stitched through the first liner 26 and second liner 34 by means of threads 74 and 76 along the side edges 46.

When assembled, it can be readily seen that the combination of the four-way stretch and two-way stretch fabrics provides an unusual combination of materials and functions not heretofore known. The center support and first and second liners provide substantial vertical support while allowing horizontal movement which is necessary for ingress and egress to the garment. The support member 50 provides horizontal support while allowing vertical stretching during such motions as diving. Optionally, the support member could support a metal cup. The garment as constructed and illustrated will cling tightly during athletic uses of stretching, bending, and twisting, will not move from its location, and yet will permit free movement of the user.

A woman's athletic garmet 80, shown in FIGS. 6–9, includes a front outer shell 82 having an upper edge 84, side edges 86, and lower edge 88. As used herein, "side edges" means all edges other than the upper and lower edges, including the edges of the leg and arm areas. The front outer shell may be made either of a four-way stretch or two-way stretch fabric, depending on the desired degree of support. If a two-way stretch fabric were used, it would be a horizontally stretchable fabric, so that the user could more easily get into and out of the garment.

A first liner 90 has an upper edge 92, side edges 94, and lower edge 96. The first liner will be attached along all of its edges to the front outer shell. It should preferably have the same number of stretch directions, i.e., either a two-way stretch or four-way stretch fabric as the front outer shell. In this manner, the liner and shell will operate and stretch together. A bra member 98, made of a vertical two-way stretch fabric, has an upper edge 100, side edges 102, and lower edge 104. It is designed to be attached along its upper edge 100 and side edges 102 to the first liner and front outer shell. A backstrap 106, made of elastic material, is attached at seams 108 and 109 to the part of the side edge of the bra 98.

A rear outer shell 110, having upper edge 112, side edges 114, and lower edge 116, is shaped so that it is easily attachable to the complementary edges of the front outer shell 82, first liner 90, and bra member 98.

It is particularly important to note that the bra member 98 is made of a vertically stretchable fabric, and is attached along its top edge 100 and side edges 102, and particularly that it is attached along the entire side edges 102, including a portion numbered **102*a*. This is important because in the prior art it was not common to attach along a side seam such as 102*a*. However, it has been found that by attaching the bra section 92 along its top and side edges, there is substantial support to the body in all positions and the bra moves with the outer shell 82 and liner 90**.

It is also important that the lower edge 104 is attached to an elastic strap 105 but is unattached to the front outer shell 82 and first liner 90. The elastic strap and vertically stretchable bra allow substantial support to the bust which, in large part, is independent of the support and movement of the outer shell 82 and first liner 90. A backstrap 106 attached at its sides 108 and 109 further supports the bra member 98.

Figure 7:
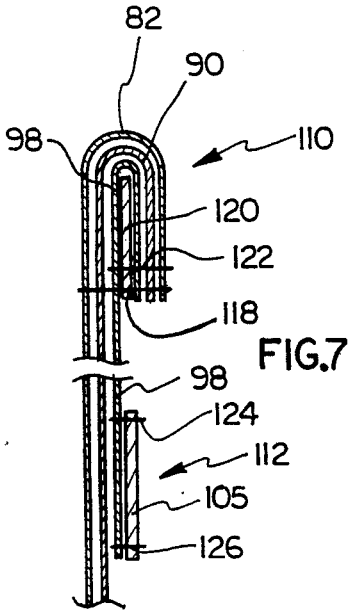
FIG. 7 is a cross-sectional view of the upper and mid-seams of the garment of FIG. 6.

FIG. 7 illustrates the upper seam 110 and center seam 112 of the bra area. The upper seam includes a lap of the outer shell 82, first liner 90, and bra 98, which are stitched at 118 to form a channel in which an elastic strap 120 is located and held by stitching 122.

Similarly, the bra section 98 is stitched at 124 and 126 to the elastic 105. The elastic section 105 is not attached to the outer shell 82 or first liner 90.

Figure 8:
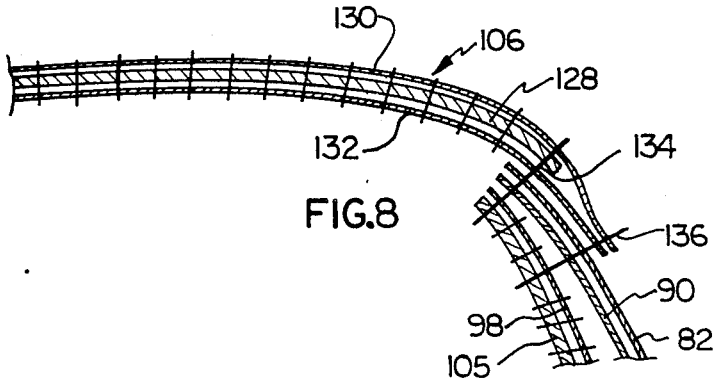
FIG. 8 is a cross-sectional view of the backstrap and side seam.
Figure 9:
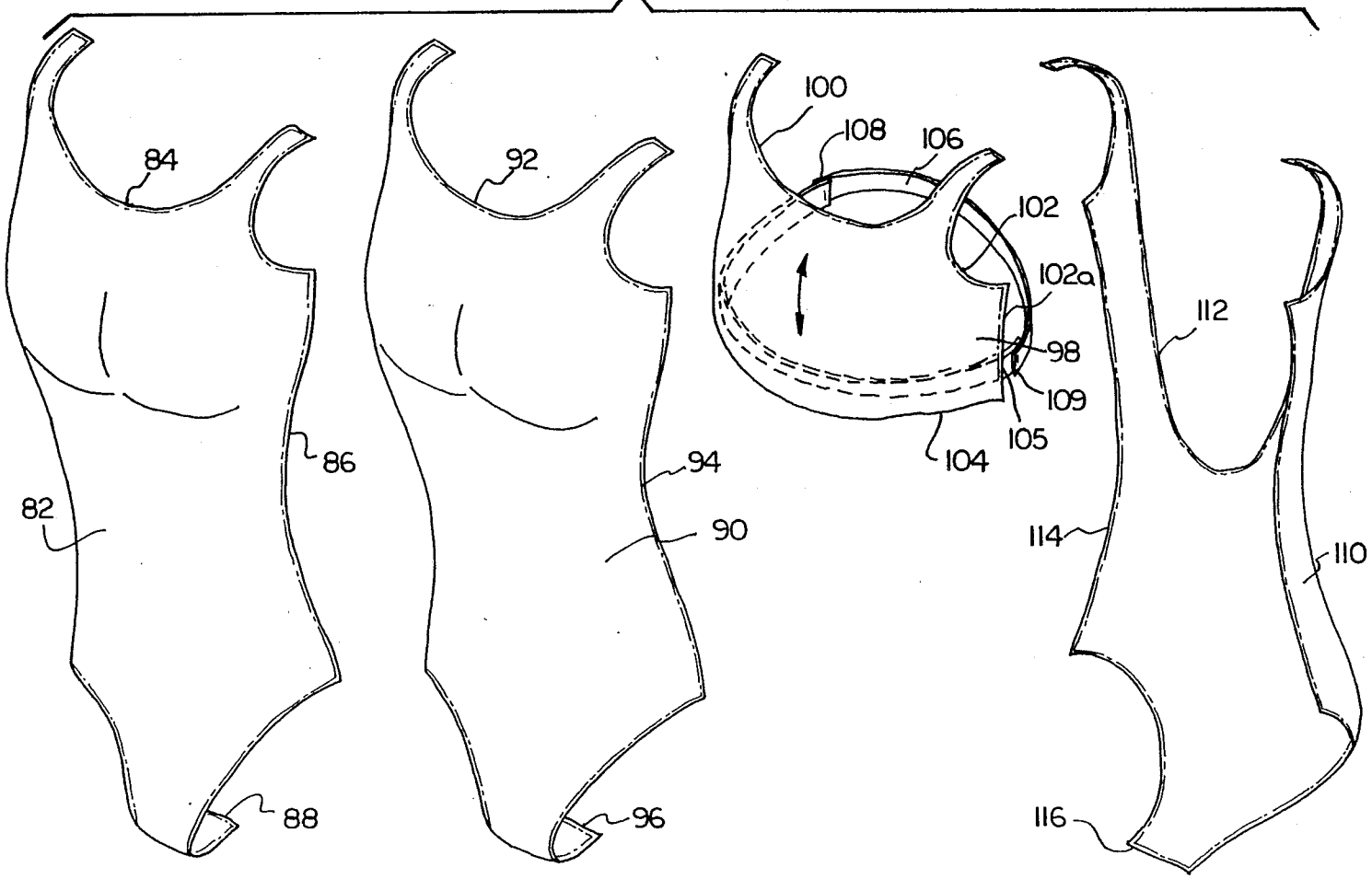
FIG. 9 is a schematic representation of the components of the garment of FIG. 6.

The side seam as shown in FIG. 8 includes the backstrap 106, which includes as elastic strap 128 which is stitched to stretchable fabric 130 and 132. Stitching 134 and 136 holds the backstrap 106 to the side member, which includes elastic 105 of the bra 98, first liner 90, and outer shell 82. The type of stitching is well known in the art, and may be any one of a number of materials. As explained hereinbefore, the two-way and four-way stretch fabrics are those enumerated above. The four-way stretch material is sold by DuPont Corp. under the trademark TRICOT, and by Gullford Corp. under the trademark RASCHE.

The garments may be assembled in different manners and sequences which will be obvious to those skilled in the art.

As assembled, the athletic garment of FIGS. 6 through 9 permits a very high level of support with the apparently contradictory full freedom of movement necessary in athletic events. By the use of four-way fabrics in the outer shell and the liner, which is the most common embodiment, virtually full, free movement is realized and there is no hindrance in either stretching, bending, or twisting. The use of the two-way fabric in the bra material provides the ability to stretch in the vertical direction while still allowing firm support. The attachment along the sides and top of the bra to the shell and to the elastic at the lower edge 104 gives maximum support, freedom of movement, and optimum fit. Accordingly, the seemingly inconsistent goals of firm support and freedom of movement are met by both of the garments illustrated herein.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A swim suit construction for securely supporting a female while allowing freedom of movement, comprising:

a front outer shell of stretch fabric having an upper edge, side edges, and a lower edge;

a front liner of stretch fabric having the same general shape as said front outer shell, said liner being attached to said front outer shell along said upper edge, side edges and bottom edge;

a bra of two-way vertically stretchable fabric positioned on the side of said front liner remote from said front shell, said bra having upper, lower and side edges attached along said upper edges to said outer shell and liner;

a rear outer shell of four-way stretch fabric having an upper edge, side edges and a bottom edge, said rear outer shell being attached along portions of said top, side and bottom edges to said front shell and liner and cooperating therewith to provide a body enclosure having arm, neck and leg openings; and said bra extending below said arm openings and being attached to said front and rear shells and said front liner along said side edges thereof below said arm openings, said bra being exposed to the interior of said swim suit;

an elastic loop means providing a front half attached to said bra along said bottom edge thereof and to said side edges of said liner and said front and back shells;

said elastic loop means providing a rear half cooperating with said front half to encircle a female body and hold the lower portion of said bra against the body of such a female;

said lower edge of said bra and elastic loop means being free of connections with said front and rear shells and said liner except along said side edges thereof;

said front liner and said shell being stretchable at least in the direction toward said side edges.

2. A swim suit as set forth in claim 1, wherein said front outer shell and said front liner are formed of two-way stretch fabric resisting stretching in a vertical direction.

3. A swim suit as set forth in claim 1, wherein said front shell and front liner are formed of four-way stretch fabric.

4. A swim suit as set forth in claim 1, wherein said elastic loop means holds said bottom edge of said bra in a firm supported position during stretching, bending and twisting.

5. The swim suit of claim 1, wherein the upper edges of the front shell, liner and bra have a lap seam which forms a channel in which an elastic band is located.

* * * * *